US005809720A

United States Patent [19]

Sauve

[11] Patent Number: 5,809,720

[45] Date of Patent: Sep. 22, 1998

[54] WATER DIVERTING BUILDING BLOCK

[75] Inventor: Dennis L. Sauve, Belle River, Canada

[73] Assignee: Newblock Corporation, Canada

[21] Appl. No.: 781,335

[22] Filed: Jan. 10, 1997

[30] Foreign Application Priority Data

Sep. 30, 1996 [CA] Canada ..... 2186809

[51] Int. Cl.[6] ..... E02D 19/00; E04B 2/42

[52] U.S. Cl. ..... 52/302.4; 52/169.5; 52/505; 52/561; 52/604; 52/605; 52/607

[58] Field of Search ..... 52/604–607, 503–505, 52/302.4, 169.5, 169.14, 561, 612

[56] References Cited

U.S. PATENT DOCUMENTS

| | | |
|---|---|---|
| 1,336,025 | 4/1920 | Cook . |
| 1,746,816 | 2/1930 | Boes . |
| 1,771,275 | 7/1930 | Stamm . |
| 2,157,290 | 5/1939 | Henderson . |
| 2,316,319 | 4/1943 | Demarest . |
| 2,530,940 | 11/1950 | Daalin . |
| 2,668,435 | 2/1954 | Clements . |
| 3,287,866 | 11/1966 | Belilacqua . |
| 4,640,071 | 2/1987 | Haener . |
| 5,115,614 | 5/1992 | McGrath . |
| 5,159,801 | 11/1992 | Schmidt ..... 52/604 X |
| 5,226,272 | 7/1993 | Sauve . |

FOREIGN PATENT DOCUMENTS

| | | |
|---|---|---|
| 52375 | 5/1977 | Australia . |
| D34571 | 11/1971 | Canada . |
| D43479 | 4/1978 | Canada . |
| D44135 | 9/1978 | Canada . |
| 2203824 | 8/1973 | Germany . |
| 2346514 | 4/1976 | Germany . |
| 611285 | 10/1948 | United Kingdom . |
| 778527 | 7/1957 | United Kingdom . |

*Primary Examiner*—Robert Canfield
*Attorney, Agent, or Firm*—Rudnick & Wolfe

[57] ABSTRACT

A hollow concrete building block is provided having physical characteristics which diverts water penetrating inside the block away from the interior of the building. The block comprises parallel interior and exterior walls and at least one transverse vertical web spanning between the walls to form a unitary block with an interior cavity. The webs have notches on the top and bottom surfaces which divert any infiltrating water into the cavities. The notches span the length of the top and bottom surfaces of the web. The apex of the top notch is proximate to the exterior wall of the block while the apex of the bottom notch is proximate to the interior wall. Once in the cavities, the water drops to the lowermost block where conventional flashing and weep holes convey the water to the exterior.

20 Claims, 3 Drawing Sheets

WATER DIVERTING BUILDING BLOCK

BACKGROUND OF THE INVENTION

1. Field of the Invention

This invention relates generally to concrete blocks used in construction of walls and particularly to such blocks having a structure which prevents water from penetrating through the wall.

2. Description of the Prior Art

Concrete building blocks of a hollow shape are commonly used in constructing exterior walls of buildings. In erecting such a wall, the concrete blocks are stacked vertically along the perimeter of the building. The top, bottom and side surfaces of each block is buttered with mortar which forms a permanent joint between abutting blocks and serves to seal the exterior face of the wall from the elements.

Conventional hollow building blocks especially in North America comprise interior and exterior parallel vertical walls with three transverse vertical webs spanning between the walls to form a rigid unitary block usually cast of concrete within a mould. The webs are inset from the transverse sides of the block such that the walls and web define two cavities within the block and, when like blocks are assembled into a constructed building wall, a cavity is defined between the outer transverse webs of adjacent blocks. The interior dimensions of the individual cavities of a block are slightly tapered to facilitate stripping of the mould from the block. Therefore, when overlapped blocks are vertically stacked, a vertical series of cavities results. Any water which penetrates the wall enters these cavities and trickles down to the ground level of the wall where conventional metal flashing and weep holes direct the water from within the vertical cavities outward.

In practice, water (either ground water or rain) infiltrates the wall and migrates through the blocks and into the interior of the building thereby causing damage to the building and its contents. Such water seepage occurs due to cracks in the concrete block wall as a result of various factors including wall settlement, improper mortar compaction or composition, voids in the mortar or the block and the inherent permeability of the mortar and block material.

Various concrete block designs have been proposed to overcome the problem of water seepage into the interior of the wall. For example, Harvey in UK Patent 611,285 describes a hollow building block having longitudinal grooves in its upper and lower surfaces to impede the infiltration of water between the block and mortar joint and to redirect the water to flow downwardly through cavities in the block. However, the grooves described by Harvey are level and would not force water to flow into such cavities.

Stamm in U.S. Pat. No. 1,771,275 teaches a building block having a continuous upper surface without any cavities. The upper surface includes a horizontal groove which forms a channel to convey water which may enter between the blocks. This block also does not force water away from the interior wall of the block. Further, adaptation of this block to one having vertical cavities would render a block similar to that of Harvey discussed above.

Thus, these methods do not adequately address the problem of water migrating from the exterior of a block to the interior by trickling across the upper surfaces of the transverse webs.

The Applicant's U.S. Pat. No. 5,226,272 (Jul. 14, 1993) addresses the above problem by providing a hollow building block short having webs with transverse grooves on their upper surfaces to channel any water entering the wall into the cavities of the block.

SUMMARY OF THE INVENTION

It is therefore an object of the present invention to overcome the deficiencies in the prior art concrete blocks and to provide a block which prevents the migration of water to the interior thereof. Specifically, the invention provides a hollow building block, for use in constructing a longitudinal vertically stacked array of like blocks, the block comprising:

first and second spaced longitudinal walls extending parallel to one another and each having an interior face directed toward one another and an exterior face directed away from one another;

at least one web extending between the longitudinal walls and having oppositely directed lateral faces extending transverse to the interior faces of the walls;

the lateral faces being interconnected at opposite edges by respective first and second lateral surfaces, at least one of the lateral surfaces having a recess formed therein;

the recess being asymmetric, extending substantially over the length of the web and being defined by a pair of oppositely inclined surfaces which promote the movement of water there along.

BRIEF DESCRIPTION OF THE DRAWINGS

These and other features of the preferred embodiment of the invention will become more apparent in the following detailed description in which reference is made to the appended drawings wherein.

DETAILED DESCRIPTION OF THE PREFERRED EMBODIMENT

Figure 1:
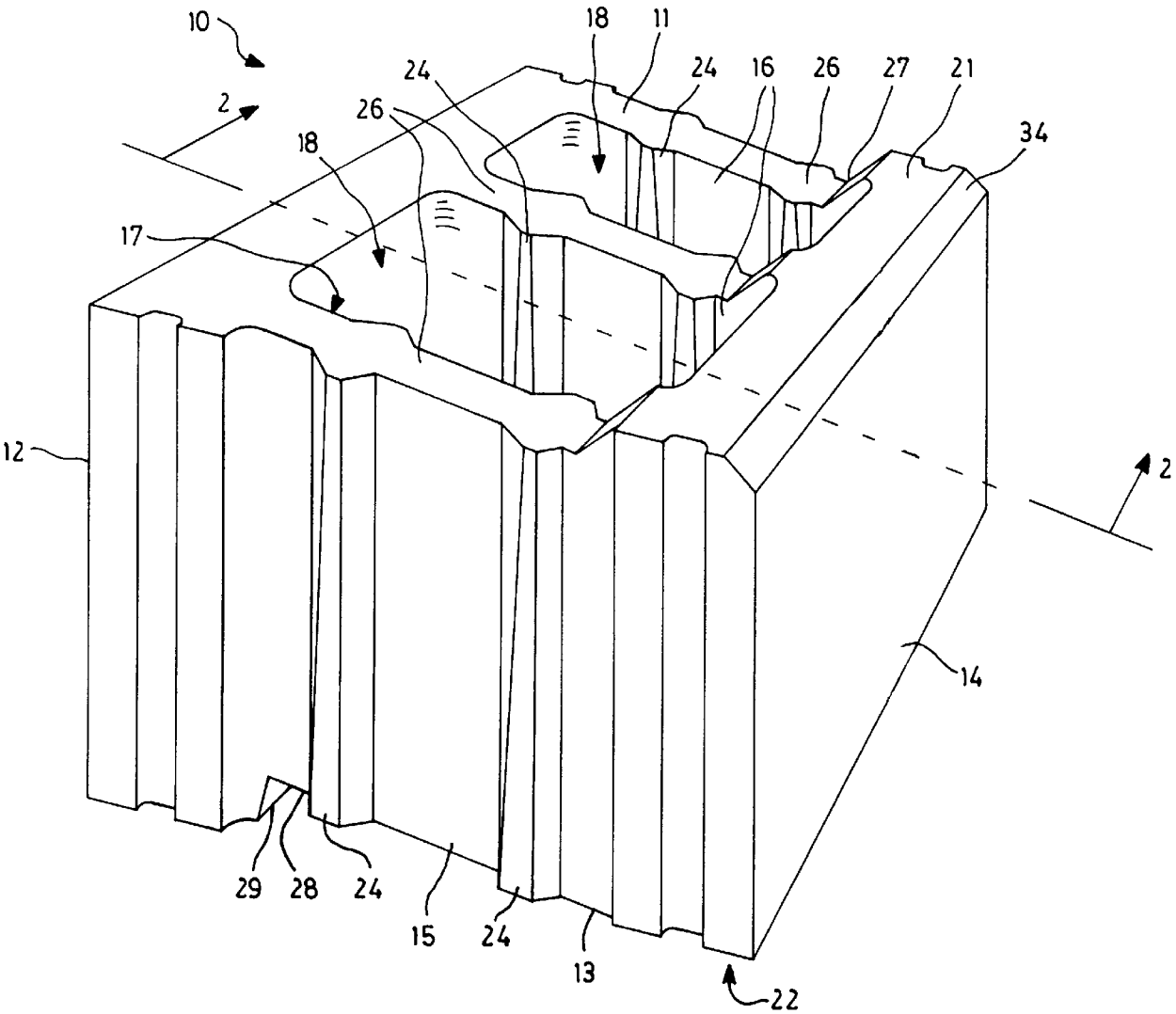
FIG. 1 is a perspective view of the block in accordance with a preferred embodiment of the present invention.

FIG. 1 illustrates a preferred embodiment wherein a concrete building block is shown generally at 10. The block comprises a rear or interior vertical longitudinal wall 12, a front or exterior vertical longitudinal wall 14 and three vertical webs 16. The walls 12 and 14 each have oppositely directed interior and exterior faces such that the interior faces face each other while the exterior faces face away from each other. The walls 12 and 14 are spaced apart and are parallel to each other with the webs 16 transverse to and spanning between the interior faces of the walls to form a rigid unitary cast concrete block. The arrangement of the walls 12 and 14 and webs 16 creates two cavities 18 of approximately the same dimensions. The block according to the preferred embodiment is also defined by top and bottom surfaces 21 and 22.

Each web 16 has upper, or first, and lower, or second, lateral surfaces 11 and 13, respectively, and a pair of oppositely directed lateral faces 15 and 17. A pair of ribs 24 are formed on each of the lateral faces to extend between the upper and lower surfaces 11 and 13. The pairs of ribs are transversely spaced from each other and taper progressively from lower surface 13 to upper surface 11.

Each of the upper and lower lateral surfaces, 11 and 13, of web 16 include asymmetric upper and lower notches 26 and 28 respectively defined by a pair of inclined surfaces

30,32. The notches preferably extend along the length of the web upper and lower lateral surfaces 11,13 and are oriented such that upper notches 26 on the upper surface 11 have their apexes 27 towards the front or exterior wall 14 while lower notches 28 on the lower surface 13 are oriented with their apexes 29 towards the rear or interior wall 12. Further, the apex 27 of each upper notch 26 is between the exterior wall 14 and the adjacent ribs 24. The longer of the inclined surfaces 30 are arranged parallel to one another and the allochiral arrangement of the notches ensures the block is reversible during the building of a wall.

Figure 2:
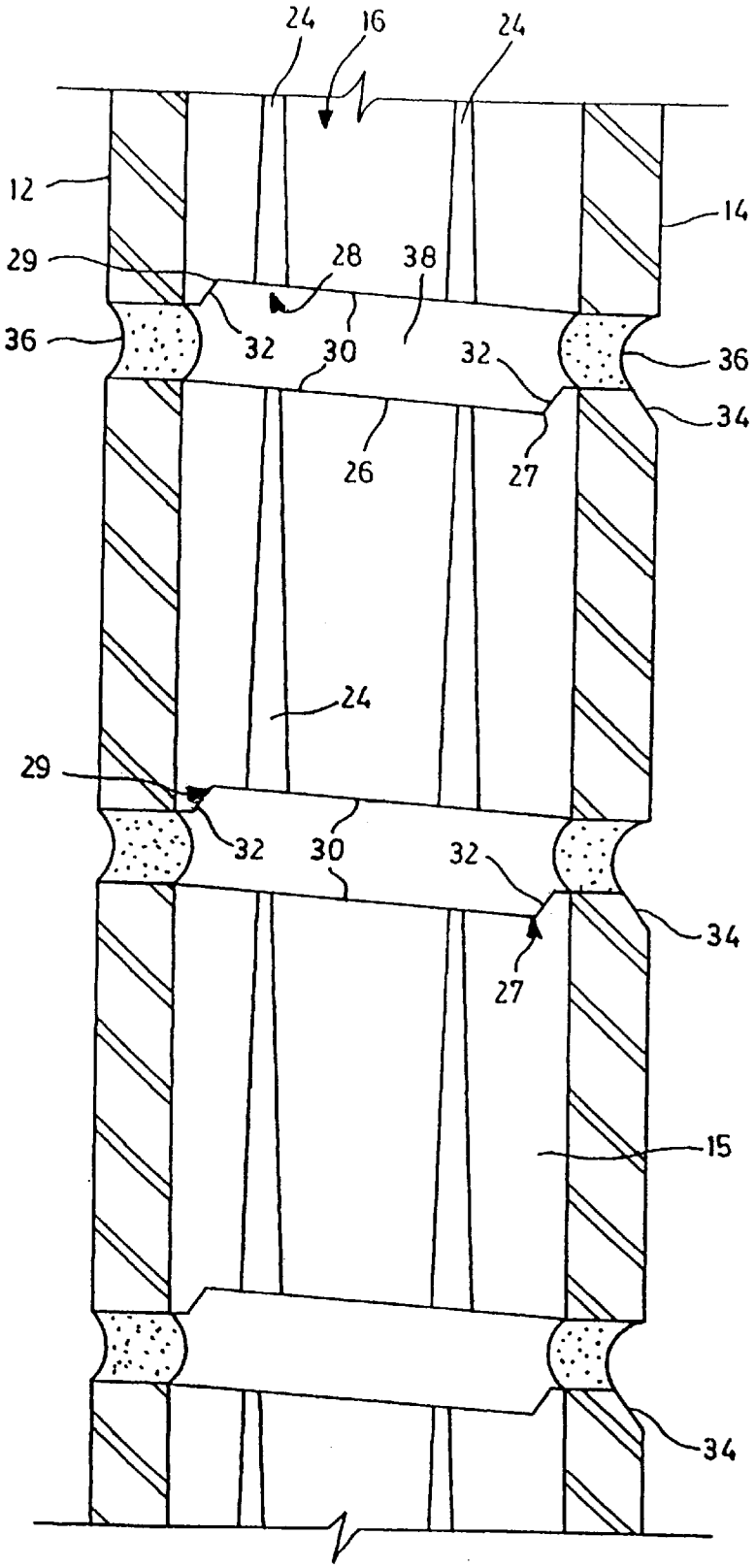
FIG. 2 is a cross sectional view on the line 2—2 of a wall formed of the blocks shown in FIG. 1.

As can be seen in FIG. 2, when building a wall built from the blocks of FIG. 1, the blocks are stacked vertically in such a way so that each web of the upper blocks lies over a web of the bottom blocks. In this manner, the cavities of each block are lined up to form vertical channels through the building wall. The blocks are stacked and joined together in a conventional manner by means of a bead of mortar 36 which is placed along the upper edges of the interior and exterior walls of each course of blocks and along the side edges (not shown). As can also be seen in FIG. 2, when the blocks are stacked, the upper and lower notches 26 and 28 cooperate to form a cavity 38.

In operation, water entering the front wall 14 of the brick either migrates to the vertical cavities 18 or to the webs 16. If water enters the cavity, it drops to the lowermost course of blocks where conventional flashing and weep holes convey the water to the exterior of the building wall. The ribs 24 on the webs 16 intercept water traveling towards the interior wall, along the lateral faces 15 and 17, and direct it towards the lower lateral surface 13, Water which migrates to the webs 16 first enters the upper notches 26. The inclined surfaces 30,32 of the upper notches 26 on the upper lateral surfaces 11 of each web 16 causes the water to flow towards the apexes 27 and therefore away from the interior wall. At the apexes 27 of the upper notches 26, the water so collected trickles into the vertical cavities and down the lateral faces 15 or 17. As the water flows down the lateral faces 15 and 17, the ribs 24 direct it to the edges of the lower notches 28 and prevent the water from migrating towards the rear wall 12. The inclined edge of each lower notch 28 causes the water to flow away from the apex 29 and towards the exterior wall 14. The water will then bead and flow into the upper notches 26 of the block below and along the lateral faces thereof, where the process is repeated.

Due to the roughness and porosity of the web surfaces it has been found that water does not flow an appreciable distance along the surface of lower notches 28 but rather water forms droplets on the surface of such notches which enlarge until their weight forces them to fall to the top notch of the block immediately below. This process is further facilitated by the angle of the notch which forces any water droplets so formed to travel to the exterior wall of the block and then to drop onto the top notch of the lower block.

In the embodiment illustrated in FIGS. 1 and 2 the blocks have a beveled upper exterior edge 34. Although an optional aesthetic feature, this edge aids in diverting water away from entering the building wall.

In the preferred embodiment, as described above, the ribs 24 are tapered having a greater width at the lower lateral surface 13 of the web 16 than at the upper lateral surface 11. The tapering of the ribs ensures that water dropping from one block to the next falls on the same side of the rib immediately below. In this manner, water is prevented from traveling further towards the interior wall of the block. Further, the tapering of the ribs allows for a slight degree of misalignment of the ribs when the blocks are laid.

The cavities 18 of each block are conventionally tapered slightly to facilitate stripping of the block from the mould. The cavity taper is such that the cavity is larger at the top surface of the block than at its bottom surface. Accordingly, the tapering of the ribs 24 does not present a difficulty in stripping of the mould away from the top surface of the block. The outward vertical edges of the ribs 24 are rounded to further facilitate stripping of the mould.

The block of the present invention can be used for both below and above grade building walls.

In the preferred embodiment, the exposed face of the exterior wall 14 of the block has a decorative finish in addition to the bevel 34. However, in another embodiment, the interior and exterior surfaces can be identical. In such case, and where the ribs are either omitted or not tapered, the block would not have differing top and bottom surfaces and therefore can be reversible.

In a further embodiment of the invention, a building block similar to that shown in FIG. 1 may be manufactured having only upper notches 26 on the upper lateral surfaces 11 of webs 16. In this embodiment the block does not have lower notches 28. In this embodiment, water that collects in upper notches 26, as described above, drops along the lateral faces 15 and 17 of the webs 16 and onto the upper notches of the block immediately below. As with the preferred embodiment, the ribs 24 on the faces 15 and 17 prevent the water from migrating towards the rear wall 12.

Figure 3:
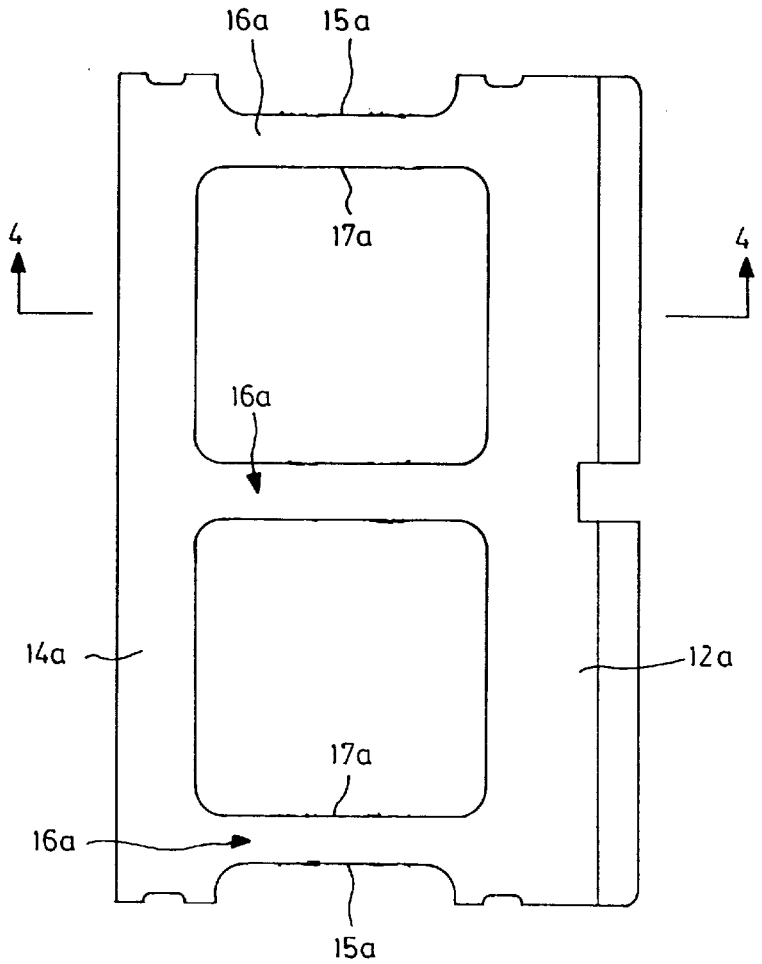
FIG. 3 is a plan view of a further embodiment.
Figure 4:
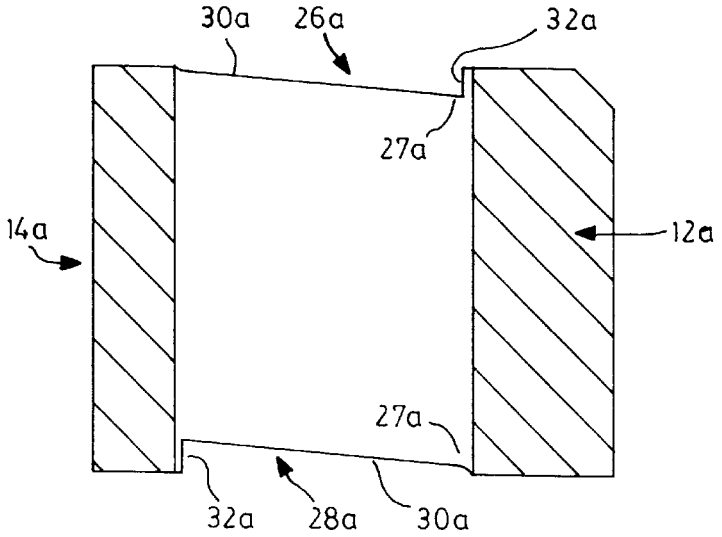
FIG. 4 is a section on the line 4—4.

A further embodiment is shown in FIGS. 3 and 4 where like numerals will be used to identify like components with a suffix 'a' added for clarity.

In the embodiment of FIGS. 3 and 4, the ribs 24 are omitted so that the lateral faces 15*a*,17*a* are smooth. The inclined surfaces 30*a*,32*a* of the upper notches 26*a* direct water to the apex 27*a* from where it may flow down the lateral faces 15*a*,17*a*. Although water may migrate toward the interior wall 14*a*, the downward path will cause it to intersect the lower notch 28*a* and be redirected toward the exterior wall 12 by the adjacent upper notch 26*a*. It will be noted that the walls 12*a*, 14*a* project slightly beyond the webs 16*a* and so a vertically extending surface does impede the flow of water along the lateral faces 15*a*,17*a*.

The notches 26*a*,28*a* are similar in profile with the longer of the inclined surfaces 30*a* being parallel to one another, each, extending substantially the length of the webs 16*a* between the walls 12*a*,14*a*. The size and depth of the notches will depend upon the block size but, by way of example, in a ten-inch block (ie. the width approximates 10"), the spacing between the length of the webs 16*a* is in the order of 5 9/16 inches and the length of the notch is 5 9/32 inches. The depth of the notch at the apex 27*a* is 9/16 inches. The inclined surface 30*a* *is recessed at a depth of* 3/16 as it terminates adjacent the respective wall 12*a*,14*a*. The inclined surface 32*a* is substantially parallel to the adjacent wall 12*a*,14*a* so that the notches 26*a*,28*a* each have an acute included angle.

Naturally the dimensions of the notches 26,28 may vary but will typically have a length of between 4 and 9 inches and with the apex between 3/8 inch and 3/4 inch below the respective lateral surface.

I claim:

1. A hollow building block, for use in constructing a longitudinal vertically stacked array of like blocks, said block comprising:

first and second spaced longitudinal walls extending parallel to one another and each having an interior face directed toward one another and an exterior face directed away from one another;

said interior face and exterior face of each side longitudinal wall being interconnected at opposite ends by respective transverse surfaces with corresponding transverse surfaces of said walls being substantially co planar to define respective oppositely directed end faces of said block generally parallel to one another and orthogonal to said faces;

at least one web extending between said longitudinal walls and having oppositely directed lateral faces extending transverse to said interior faces of said walls;

said lateral faces being interconnected at opposite edges by respective first and second lateral surfaces, at least one of said lateral surfaces having a recess formed therein;

said recess being asymmetric, extending substantially over the length of said web and being defined by a pair of oppositely inclined surfaces to promote the movement of water there along.

2. A block as claimed in claim 1 wherein each of said lateral surfaces has a recess.

3. A block as claimed in claim 2 wherein said recesses are asymmetrical notches.

4. A block as claimed in claim 3 wherein the apexes of said notches on said first lateral surface are proximate to said first longitudinal wall and the apexes of said notches on said second lateral surface are proximate to said second longitudinal wall.

5. A block as in claim 4 wherein said notches extend over the length of said first and second lateral surfaces.

6. A block as claimed in claim 5 wherein said web lateral faces have at least one rib extending between said lateral surfaces.

7. A block as claimed in claim 6 wherein each of said ribs is tapered having a greater width at said second lateral surface than at said first lateral surface.

8. A block as claimed in claim 7 wherein each of said web lateral surfaces have two ribs.

9. A block as claimed in claim 8 wherein said block is cast of concrete.

10. A hollow building block for use in constructing a longitudinal vertically stacked array of like blocks, said block comprising:

first and second spaced longitudinal walls extending parallel to one another and each having an interior face directed toward one another and an exterior face directed away from one another;

at least one web extending between said longitudinal walls and having oppositely directed lateral faces extending transverse to said interior faces of said walls;

said lateral faces being interconnected at opposite edges by respective first and second lateral surfaces;

each of said lateral surfaces having an asymmetric notch formed therein and extending along said lateral surfaces;

said notches being asymmetric and defined by a pair of oppositely inclined surfaces which promote the movement of water there along, said inclined surfaces forming an apex; and wherein the apex on said first lateral surface is proximate to said first longitudinal wall and the apex on said second lateral surface is proximate to said second longitudinal wall.

11. A block as claimed in claim 10 wherein said web lateral faces have at least one rib extending between said lateral surfaces.

12. A block as claimed in claim 11 wherein said block is cast of concrete.

13. A building wall assembled of a plurality of hollow building blocks, wherein each of said blocks comprises:

first and second spaced longitudinal walls extending parallel to one another and each having an interior face directed toward one another and an exterior face directed away from one another, said interior face and exterior face of each side longitudinal wall being interconnected at opposite ends by respective transverse surfaces with corresponding transverse surfaces of said walls being substantially co planar to define respective oppositely directed end faces of said block generally parallel to one another and orthogonal to said faces;

at least one web extending between said longitudinal walls and having oppositely directed lateral faces extending transverse to said interior faces of said walls;

said lateral faces being interconnected at opposite edges by respective first and second lateral surfaces, at least one of said lateral surfaces having a recess formed therein;

said recess being asymmetric, extending substantially over the length of said web and being defined by a pair of oppositely inclined surfaces to promote the movement of water there along.

14. A building wall as claimed in claim 13, wherein each of said lateral surfaces of said blocks has a recess.

15. A building wall as claimed in claim 14, wherein said recesses are asymmetrical notches, extending along respective lateral surfaces of said block.

16. A building wall as claimed in claim 15, wherein said inclined surfaces forming an apex, wherein the apexes of said notches on said first lateral surface are proximate to said first longitudinal wall of said block and the apexes of said notches on said second lateral surface are proximate to said second longitudinal wall of said block.

17. A building wall as claimed in claim 16, wherein said notches extend over the length of respective lateral surfaces of said block.

18. A building wall as claimed in claim 17, wherein said web lateral surfaces of said block have at least one rib extending between said lateral surfaces.

19. A building wall as claimed in claim 18, wherein each of said ribs is tapered having a greater width at said second lateral surface than at said first lateral surface.

20. A building wall as claimed in claim 19, wherein said blocks are cast of concrete.

* * * * *